US009434198B2

(12) United States Patent
Vreeland et al.

(10) Patent No.: US 9,434,198 B2
(45) Date of Patent: Sep. 6, 2016

(54) HEAT TRANSFERABLE MATERIAL FOR IMPROVED IMAGE STABILITY

(71) Applicant: Kodak Alaris Inc., Rochester, NY (US)

(72) Inventors: William B. Vreeland, Webster, NY (US); David George Foster, West Henrietta, NY (US)

(73) Assignee: Kodak Alaris Inc., Rochester, NY (US)

( * ) Notice: Subject to any disclaimer, the term of this patent is extended or adjusted under 35 U.S.C. 154(b) by 0 days.

(21) Appl. No.: 13/745,883

(22) Filed: Jan. 21, 2013

(65) Prior Publication Data

US 2013/0133818 A1 May 30, 2013

Related U.S. Application Data

(63) Continuation-in-part of application No. 13/660,192, filed on Oct. 25, 2012, which is a continuation of application No. 12/565,112, filed on Sep. 23, 2009, now Pat. No. 8,318,271, which is a continuation-in-part of application No. 12/436,833, filed on May 7, 2009, now abandoned.

(60) Provisional application No. 61/156,605, filed on Mar. 2, 2009.

(51) Int. Cl.

| | |
|---|---|
| ***B41M 5/40*** | (2006.01) |
| ***B41M 5/26*** | (2006.01) |
| ***B41M 7/00*** | (2006.01) |
| *B41M 5/392* | (2006.01) |
| *B41M 5/42* | (2006.01) |

(52) U.S. Cl.

CPC ..... *B41M 5/26* (2013.01); *B41M 7/0027* (2013.01); *B41M 5/392* (2013.01); *B41M 5/423* (2013.01); *B41M 2205/06* (2013.01); *B41M 2205/30* (2013.01); *B41M 2205/40* (2013.01)

(58) Field of Classification Search

CPC .. B41M 5/392; B41M 5/423; B41M 7/0027; B41M 2205/06; B41M 2205/30; B41M 2205/40

USPC ..... 428/2.6, 32.52, 32.85; 524/99

See application file for complete search history.

(56) References Cited

U.S. PATENT DOCUMENTS

| | | | | |
|---|---|---|---|---|
| 5,318,882 | A | 6/1994 | Ootaguro et al. | |
| 5,332,713 | A | 7/1994 | Oldfield et al. | |
| 5,387,573 | A | 2/1995 | Oldfield et al. | |
| 5,670,449 | A * | 9/1997 | Simpson et al. | 503/227 |
| 5,954,906 | A | 9/1999 | Abe et al. | |
| 6,593,406 | B2 | 7/2003 | Sargeant et al. | |
| 6,919,109 | B2 | 7/2005 | Nakano et al. | |
| 6,942,986 | B2 | 9/2005 | Bassler | |
| 7,226,891 | B2 | 6/2007 | Nakayama et al. | |
| 7,301,012 | B2 | 11/2007 | Fujiwara | |
| 7,384,138 | B2 | 6/2008 | Taguchi | |
| 8,304,044 | B2 | 11/2012 | Vreeland | |

(Continued)

FOREIGN PATENT DOCUMENTS

| | | |
|---|---|---|
| JP | 03-112685 | 5/1991 |
| JP | H10-071765 | 3/1998 |

(Continued)

OTHER PUBLICATIONS

Goldstein et al., J. Am. Chem. Soc., 2003, (125), 789-795.

(Continued)

*Primary Examiner* — Wenwen Cai

(74) *Attorney, Agent, or Firm* — Hogan Lovells US LLP

(57) ABSTRACT

A heat transferable material includes a heat transferable polymeric binder and a light stabilizer that is an N-oxyl radical derived from a hindered amine. The N-oxyl radical has the following formula (A) or formula (B):

(A)

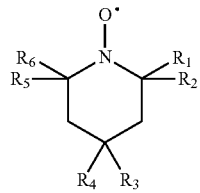

(B)

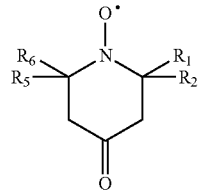

wherein $R_1$, $R_2$, $R_5$, and $R_6$ are each a straight or branched $C_1$-$C_6$ alkyl or alkene, and $R_3$ and $R_4$ are each independently H, $CH_2CH_3$, $CH_3$, OH, OR, COOH, COOR, or NH—C(=O)R, wherein R is a straight or branched $C_1$-$C_6$ alkyl or alkene, and having a molecular weight of 600 or less. At least one of $R_3$ and $R_4$ is not hydrogen. The heat transferable material can be in a section or patch on a thermal donor element to provide a protective overcoat material. A patch in the donor element can include a dye. The heat transferable material provides better image stability and improved iridescence when transferred to a receiver of some type.

15 Claims, No Drawings

(56) References Cited

U.S. PATENT DOCUMENTS

| | | | | |
|---|---|---|---|---|
| 8,318,271 | B2 | 11/2012 | Vreeland | |
| 2004/0074417 | A1* | 4/2004 | Biry | 106/31.01 |
| 2005/0255314 | A1* | 11/2005 | Wang et al. | 428/352 |

FOREIGN PATENT DOCUMENTS

| | | |
|---|---|---|
| JP | H11-170686 | 6/1999 |
| JP | 2000-185383 | 7/2000 |
| JP | 2001-071640 | 3/2001 |
| WO | 2007/069504 | 6/2007 |

OTHER PUBLICATIONS

Thermal dye transfer, Research Disclosure, 320019, Dec. 1990.

Notice of Preliminary Rejection mailed Jun. 19, 2016 in corresponding Korean Patent Application No. KR 2011-7023113 (English translation provided).

* cited by examiner

HEAT TRANSFERABLE MATERIAL FOR IMPROVED IMAGE STABILITY

CROSS-REFERENCE TO RELATED APPLICATIONS

This application is a Continuation-in-part of U.S. Ser. No. 13/660,192 that was filed on Oct. 25, 2012 as a Continuation of U.S. Ser. No. 12/565,112 that was filed by William Vreeland on Sep. 23, 2009 and is now granted as U.S. Pat. No. 8,318,271, which in turn was filed as a Continuation-in-part of U.S. Ser. No. 12/436,833 by William Vreeland on May 7, 2009, and for which reference is also made to and priority claimed from U.S. Provisional Application Ser. No. 61/156,605, filed by me on Mar. 2, 2009.

Also referenced is copending and commonly assigned U.S. Ser. No. 12/565,140 that was filed by William Vreeland on Sep. 23, 2009 and is now granted as U.S. Pat. No. 8,304,044.

FIELD OF THE INVENTION

The present invention relates to a heat transferable material including a heat transferable polymeric binder and an N-oxyl radical that is derived from a hindered amine, and that behaves as a light stabilizer that provides improved image stability and reduced iridescence when applied to a receiver.

BACKGROUND OF THE INVENTION

There are many ways of forming an image. Images can be formed through thermal transfer of dyes, inkjet applications, electrophotographic reproduction, and silver halide image development. Also known is that all such images are susceptible to environmental factors, particularly light fade. Thermal, inkjet, and electrophotographic images also can suffer from iridescence problems, which are unsightly to the viewer. Typically, iridescence is caused by the interaction between the materials on the receiver and any materials applied to the receiver in forming the image.

To form any printed image, the image is either chemically developed from film, or developed from an electronic signal generated from either a digital capture device, or scanning of a film. For thermal, inkjet, and electrophotographic prints, electronic signals indicating appropriate colors are used to produce cyan, magenta and yellow color signals. These signals are then transmitted to a printer where colored material is transferred to a receiver. A color hard copy is thus obtained that corresponds to the original image.

Thermal, ink jet, and electrophotographic prints are susceptible to retransfer of colorants to adjacent surfaces and to discoloration by fingerprints because the colorants remain at the surface of the receiver. Heat can be used to drive the colorants deeper into the receiver. Application of a protective overcoat on these types of prints, as well as silver halide prints, is also known, and effectively reduces retransfer and discoloration by adding a protective polymeric layer over the image.

The protective overcoat can also provide improved light stability to the underlying imaging colorants, including dyes. The most common approach is to filter out UV radiation since it is known that UV radiation is detrimental to the underlying colorants. Improved image stability can be achieved with the addition of a UV absorbing dye in a protective overcoat, as described in U.S. Pat. No. 4,522,881. This approach has practical limitations on the amount of UV radiation that can be absorbed because there is a practical limitation on the thickness of the protective overcoat as well as the concentration of the UV absorbing dye that can be applied.

Improved image stability can also be achieved by incorporating light stabilizers in close proximity to the colorants within the receiver. Light stabilizers can be added to the receiver during manufacture by aqueous or solvent coating or thermal extrusion of materials incorporating the light stabilizers. If thermal extrusion is used, only light stabilizers with very high thermal stabilities can be used due to the temperatures of extrusion, typically 250° C. or higher. The light stabilizers must be incorporated within the receiver in such a manner that they will react with the colorants when applied to the receiver.

U.S. Pat. No. 5,332,713 discloses a transferable protection overcoat on a donor element for transfer to a thermal print. The transferable protection overcoat comprises poly(vinyl formal), poly(vinyl benzal) or poly(vinyl acetal) containing at least about 5 mole % hydroxyl. The overcoat provides inferior gloss and iridescence performance due to refractive index mismatch with the dye receiving layer.

U.S. Pat. No. 5,387,573 discloses a protective overcoat including particles in an amount of up to about 75% of the thickness of the heat transferable protective overcoat. Although the particles reduce the iridescence problems, the particles lower the gloss of the imaged print.

U.S. Pat. No. 5,670,449 discloses the use of elastomeric beads in a protective overcoat for better raw-stock keeping, but the gloss performance of these protective overcoats is not optimum.

U.S. Pat. No. 6,942,956 discloses a protective overcoat comprising a gloss-enhancing agent, and a mixture of inorganic and organic particles. In some embodiments, the protection layer contains from about 5% to about 60% by weight inorganic particles, from about 25% to about 80% by weight polymeric binder and from about 5% to about 60% by weight of organic particles, and an effective amount of at least one gloss-enhancing compound. The gloss enhancing compound consists of an organic molecule that is essentially colorless, does not scatter light, is substantially not absorbing of light at a wavelength from 400 to 800 nm, and has a maximum absorption at a wavelength less than 400 nm. The inorganic particles, e.g. silica, are required to provide smooth protective overcoat tear-off, but these degrade gloss and are detrimental to the gravure coating quality. The organic particles are required to reduce iridescence, but these reduce gloss. The gloss improvement provided is not adequate.

U.S. Pat. Nos. 7,301,012 and 7,384,138 disclose the use of hindered amine light stabilizers (HALS) in a receiver to provide image dye stability.

There remains a need for a heat transferable protective overcoat that provides greater image stability, reduced iridescence, and can be manufactured at low cost.

SUMMARY OF THE INVENTION

The present invention relates to a heat transferable donor element comprising a polymeric support, the support having at least one portion thereof coated with a heat transferable material comprising a polymeric binder and at least one light stabilizer that is an N-oxyl radical derived from a hindered amine, the N-oxyl radical having the following formula (A) or formula (B):

(A)

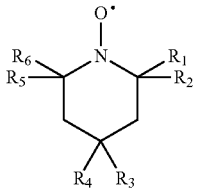

(B)

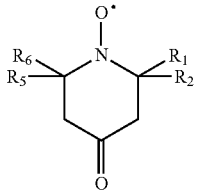

wherein $R_1$, $R_2$, $R_5$, and $R_6$ are each independently selected from a straight or branched $C_1$-$C_6$ alkyl or alkene, and $R_3$ and $R_4$ are each independently selected from H, $CH_2CH_3$, $CH_3$, OH, OR, COOH, COOR, or NH—(C═O)R, wherein R is a straight or branched $C_1$-$C_6$ alkyl or alkene, and having a molecular weight of 600 or less, except that at least one of $R_3$ and $R_4$ is not hydrogen.

In other embodiments of this invention, a heat transferable overcoat material comprises a heat transferable polymeric binder and a light stabilizer that is an N-oxyl radical that is derived from a hindered amine, the N-oxyl radical having the following formula (A) or formula (B):

(A)

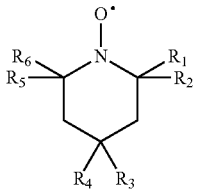

(B)

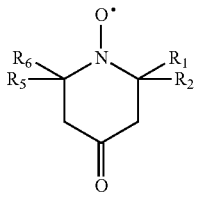

wherein $R_1$, $R_2$, $R_5$, and $R_6$ are each independently selected from a straight or branched $C_1$-$C_6$ alkyl or alkene, and $R_3$ and $R_4$ are each independently selected from H, $CH_2CH_3$, $CH_3$, OH, OR, COOH, COOR, or NH—C(═O)R, wherein R is a straight or branched $C_1$-$C_6$ alkyl or alkene, and having a molecular weight of 600 or less, except that at least one of $R_3$ and $R_4$ is not hydrogen.

For example, the present invention also provides a donor element comprising a polymeric support and the heat transferable overcoat material described above.

This invention further provides a method of coating a receiver element with a protective overcoat material, comprising:

contacting the donor element of the present invention with a receiver element;

applying heat or pressure sufficient to transfer the protective overcoat material from the donor element to the receiver element.

A thermal transfer assemblage of this invention comprises a receiver element in contact with at least a portion of a heat transferable donor element, wherein the donor element comprises a polymeric support at least one portion thereof coated with a heat transferable material comprising a heat transferable polymeric binder and a light stabilizer that is an N-oxyl radical derived from a hindered amine, the N-oxyl radical having the following formula (A) or formula (B):

(A)

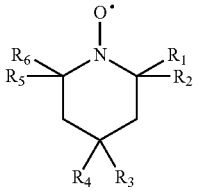

(B)

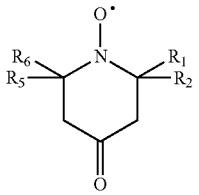

wherein $R_1$, $R_2$, $R_5$, and $R_6$ are each independently selected from a straight or branched $C_1$-$C_6$ alkyl or alkene, and $R_3$ and $R_4$ are each independently selected from H, $CH_2CH_3$, $CH_3$, OH, OR, COOH, COOR, or NH—C(═O)R, wherein R is a straight or branched $C_1$-$C_6$ alkyl or alkene, and having a molecular weight of 600 or less, except that at least one of $R_3$ and $R_4$ is not hydrogen.

The heat transferable material can be in one or more protective overcoat patches. Suitable receiver elements for transfer of a protective overcoat include any colorant containing material, including, for example, an inkjet receiver, a thermal receiver, an electrophotographic receiver, or a silver halide print.

The heat transferable donor element of this invention containing a transferable polymeric binder and a transferable N-oxyl radical light stabilizer provides the advantages of reducing light fade, reducing iridescence, and lowering costs for image production by reducing or eliminating the need for UV absorbing materials. Other advantages will be apparent upon review of this document in full.

DETAILED DESCRIPTION OF THE INVENTION

The invention relates to a heat transferable donor element for use with receivers for thermal, inkjet, and electrophotographic printing, as well as silver halide prints. A heat transferable material is present on at least a portion of the heat transferable donor element, wherein the donor element has a support and disposed on at least one side of the support, a heat transferable polymeric binder and at least one (that is, one or more) light stabilizer that is an N-oxyl radical that is derived from a hindered amine. Sometimes this N-oxyl radical is known in the art as a "hindered amine light stabilizer" (HALS). The N-oxyl radical has a molecular weight of at least 140 and less than 600 and generally has the following formula (A) or formula (B):

(A)

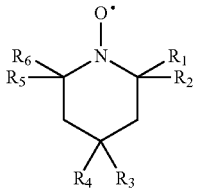

(B)

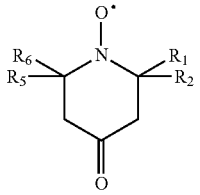

wherein $R_1$, $R_2$, $R_5$, and $R_6$ are each independently selected from a straight or branched $C_1$-$C_6$ alkyl or alkene, and $R_3$ and $R_4$ are each independently selected from H, $CH_2CH_3$, $CH_3$, OH, OR, COOH, COOR, or NH—C(═O)R, wherein R is a straight or branched C1-C6 alkyl or alkene. However, at least one of $R_3$ and $R_4$ is not hydrogen.

According to various embodiments, at least one of $R_3$ and $R_4$ is $CH_2CH_3$, $CH_3$, OH, or NH—(C═O)$CH_3$. For example, at least one of $R_3$ and $R_4$ is OH. According to various embodiments, $R_1$, $R_2$, $R_5$, and $R_6$ are independently chosen from $CH_2CH_3$, $CH_3$, or H. For example, $R_1$, $R_2$, $R_5$, and $R_6$ can each be $CH_3$ or each of $R_1$, $R_2$, $R_5$, and $R_6$ is $CH_2CH_3$. A useful compound is described below in Invention Example 1.

It is noted that the light stabilizer is an oxyl radical, and is a singlet oxygen quencher. It is present in an active form. When present in a heat transferable material on a donor element, the light stabilizer is transferred like a colorless dye from the donor element or to a receiver element upon printing. That is, the light stabilizer migrates upon heating from the heat transferable donor element to the receiver element. For this reason, an N-oxyl radical light stabilizer with a low molecular weight as noted above is desired so that it can more easily transfer between the donor element and receiver element. Similarly, side chains for $R_1$-$R_6$ with less steric hindrance are useful to enable migration.

It has been observed that the N-oxyl radical appears to react to the presence of plasticizer and bind thereto. The presence of a plasticizer in the receiver layer to which the N-oxyl radical is being transferred appears to bind the N-oxyl radical and prevent any retransfer or further migration into the other receiver layers. Presence of plasticizer in the heat transferable material including the N-oxyl radical can hamper transfer of light stabilizer to the receiver element, instead mordanting the HALS in the patch on the donor element. It is desirable to have little or no plasticizer present in the heat transferable material including the N-oxyl radical, for example, an amount of plasticizer of 5% or less by weight of the heat transferable material, typically 3% or less by weight, more typically up to and including 2% by weight. In many embodiments, there is no plasticizer in the heat transferable material.

Any material can be used as the support for the donor element of the invention provided it is dimensionally stable and can withstand the heat of thermal transfer, for example from a thermal printing head. Suitable materials can include, for example, polyesters such as poly(ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support can have a thickness of from about 2 μm to and including 30 μm, although thicker or thinner supports could be used for specific applications. According to certain embodiments where a high gloss image is desired, the support can have a surface roughness, Ra, of 18 nm or less on the side of the support on which the heat transferable material is provided.

The heat transferable material can be provided in one or more sections, or patches, on the donor element, or a single heat transferable material can coat the length of the donor element. The donor element can be provided as sheets or rolls of any desired width and length suitable for the intended thermal transfer apparatus. The patches on a donor element can be the same or different, and can be in a repeating pattern if desired. The patches provide a protective overcoat. A donor element can also include one or more colored dye patches followed by a protective overcoat patch, or a single color patch followed by a protective overcoat patch. The sequence can be repeated, if desired. An exemplary sequence commonly used in thermal dye diffusion printing is a repeat of yellow, magenta, cyan, and protective overcoat patches. The present invention is directed to the protective overcoat patches that can be used solely in the donor element or as protective overcoat patches along with one or more color patches.

A UV absorber can be present in amounts of 20% or less by weight, or 5% or less in the heat transferable material. In some instances no UV absorber is present.

For the protective overcoat patches, the heat transferable material comprises, besides the N-oxyl radical light stabilizer, one or more heat transferable polymeric binders. Any known heat transferable polymeric binder can be used. For example, the present invention can include the use of a heat transferable polymeric binder blend for use in heat transferable material such as a polyvinyl acetal resin blended with a polystyrene/allyl alcohol copolymer incorporating one or more heat transferable N-oxyl radical light stabilizers derived from the hindered amines that results in improved image stability of the resulting dye diffusion thermal transfer prints. This resin blend may be used in the protective overcoat layer or patch. The protective overcoat layer is generally included in final prints with enhanced optical properties. The protective overcoat layer provides better refractive index matching with the underlying dye receiving layer. In addition to its use in dye diffusion thermal transfer systems, the layer may be used in applications such as, for example, a thermal transfer layer applied to an inkjet receiver.

The application of a protective overcoat layer or patch can eliminate concerns commonly encountered with dye diffusion thermal transfer prints. In addition, the protective overcoat layer or patch can also provide improved dye stability by acting as a barrier to UV light and pollutant gases such as ozone and nitrogen dioxide. If desired, the protective overcoat layer or patch may also provide the prints with a glossy surface, comparable to that obtained from glossy silver-halide photographic prints, with no iridescence. For example, the gloss, when measured at 20°, is at least 50 when transferred at a line time of 1 ms, and at least 45 when transferred at a line time of 0.5 ms. The protective overcoat layer desirably results in a smooth tear-off between transferred and non-transferred protective overcoat. For improvements in manufacturing, it is desirable that the materials utilized in the protective overcoat layer or patch enable use of low-cost solvents.

In particulate, the heat transferable donor element of this invention is a protective overcoat layer patch (or protective material) on a thermal print provided by uniform application of heat using a thermal head. The protective overcoat layer, which may also be referred to as a protective overcoat or protective overcoat patch, can include at least one poly(vinyl acetal) resin of the following Formula I:

Formula I

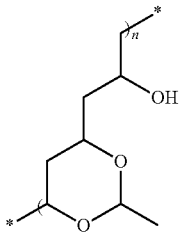

wherein n is from 10 to 100. The average molecular weight can be in the range of at least 4,000 to and including 100,000, for example at least 15,000 to and including 80,000. Optionally, the protective overcoat layer can also include at least one styrene/allyl alcohol copolymer resin, such as Lyondell SAA-100. As noted above, the protective overcoat layer also includes one or more N-oxyl radical light stabilizers, for example as defined above.

For example, the heat transferable material can comprise at least 40% to and including 90% by weight of the resin of Formula I, and at least 2 weight % to and including 20 weight % of a UV absorbing material, based on the total dry weight of the heat transferable material.

In one embodiment of the invention, the protective overcoat layer is the only layer on the donor element and can be used in conjunction with a dye donor element that contains the heat transferable image dyes.

For example, in many embodiments, the heat transferable polymers used in the protective overcoat layer comprise a polyvinyl acetal resin blended with a polystyrene/allyl alcohol resin. When used in a thermal transfer system, the refractive index of the poly(vinyl acetal) resin blended with a polystyrene/allyl alcohol resin can be closely matched to the refractive index of the dye receiving layer to alleviate the low gloss of current protective overcoat, resulting from the mismatch in refractive index between dye receiving layer and the protective overcoat layer. Typically, refractive index is in the range of at least 1.50 to and including 1.65, more typically in the range of from at least 1.54 to and including 1.65. Use of the poly(vinyl acetal) resin blended with a polystyrene/allyl alcohol resin gives gloss values 10-15 units higher than the gloss values achieved with a poly(vinyl acetal) protective overcoat, as measured with a BYK-Gardner micro-TRI-Gloss® meter (see experimental section).

In one embodiment, the protective overcoat layer may contain crosslinked elastomeric organic beads. The beads can have a glass transition temperature (Tg) of 45° C. or less, for example, 10° C. or less. The elastomeric beads can be made from an acrylic polymer or copolymer, such as butyl-, ethyl-, propyl-, hexyl-, 2-ethylhexyl-, 2-chloroethyl-, 4-chlorobutyl- or 2-ethoxyethylacrylate or methacrylate; acrylic acid; methacrylic acid; hydroxyethyl acrylate; a styrenic copolymer, such as styrene-butadiene, styrene-acrylonitrile-butadiene, styrene-isoprene, or hydrogenated styrene-butadiene; or mixtures thereof. The elastomeric beads can be crosslinked with various crosslinking agents, which can be part of the elastomeric copolymer, such as but not limited to divinylbenzene; ethylene glycol diacrylate; 1,4-cyclohexylene-bis(oxyethyl)dimethacrylate; 1,4-cyclohexylene-bis(oxypropyl)diacrylate; 1,4-cyclohexylene-bis(oxypropyl)dimethacrylate; and ethylene glycol dimethacrylate. The elastomeric beads can have at least 1% to and including 40%, for example, at least 5% to and including 40%, by weight of a crosslinking agent. The elastomeric microbeads may be employed in any amount effective for the intended purpose. In general, good results have been obtained at a coverage of at least 2 mg/m$^2$ to and including 25 mg/m$^2$. The elastomeric microbeads generally have a particle size of at least 4 μm to and including 10 μm. At these levels, the beads are not detrimental to gloss, and are beneficial for finishing operations involving web-transport and spool winding.

The elastomeric beads may be crosslinked with various crosslinking agents, which may also be part of the elastomeric copolymer, such as divinylbenzene; ethylene glycol diacrylate; 1,4-cyclohexylene-bis(oxyethyl)dimethacrylate; 1,4-cyclohexylene-bis(oxypropyl)diacrylate; 1,4-cyclohexylene-bis(oxypropyl)dimethacrylate; and ethylene glycol diacrylate.

The glass transition temperatures can be determined by the method of differential scanning calorimetry (DSC) at a scanning rate of 20° C./minute and the onset in the change in heat capacity was taken as the Tg.

Following are examples of typical elastomeric microbeads that may be employed in the invention:

Bead 1) poly(butyl acrylate-co-divinylbenzene) (80:20 mole ratio) having a nominal diameter of approximately 4 μm and a Tg of approximately −31° C.

Bead 2) poly(styrene-co-butyl acrylate-co-divinylbenzene) (40:40:20 mole ratio) having a nominal diameter of approximately 4 μm and a Tg of approximately 45° C.

Bead 3) poly(ethyl acrylate-co-ethylene glycol diacrylate) (90:10 mole ratio) having a nominal diameter of approximately 5 μm and a Tg of approximately −22° C.

Bead 4) poly(2-ethylhexyl acrylate-co-styrene-co-divinylbenzene) (45:40:15 mole ratio) having a nominal diameter of approximately 5 μm and a Tg of approximately 20° C.

Bead 5) poly[2-chloroethylacrylate-co-1,4-cyclohexylene-bis(oxypropyl)diacrylate] (80:20 mole ratio) having a nominal diameter of approximately 7 μm and a Tg of approximately −10° C.

Bead 6) poly(butyl methacrylate-co-hydroxyethyl-acrylate-co-divinylbenzene) (65:10:25 mole ratio) having a nominal diameter of approximately 6 μm and a Tg of approximately 29° C.

Bead 7) poly(styrene-co-butadiene-co-divinylbenzene) (40:50:1.0 mole ratio) having a nominal diameter of approximately 8 μm and a Tg of approximately −55° C.

Bead 8) poly(styrene-co-2-ethyoxyethyl acrylate-co-ethylene glycol diacrylate) (20:45:35 mole ratio) having a nominal diameter of approximately 4 μm and a Tg of approximately −5° C.

Bead 9) polystyrene-co-hexyl acrylate-co-divinylbenzene) (10:70:20 mole ratio) having a nominal diameter of approximately 4 μm and a Tg of approximately −15° C.

Non-heat transferable polymeric binders may also be present in the donor element but they are not transferred during thermal printing. Such polymeric binders are well known in the art and include but are not limited to, thermoplastic resins, for example, acrylic resins, such as poly (methyl methacrylate), poly(ethyl methacrylate), poly(butyl acrylate), vinyl resins, such as poly(vinyl acetate), vinyl chloride-vinyl acetate copolymer, poly(vinyl alcohol), poly (vinyl butyral), and cellulose derivatives, such as ethyl cellulose, nitrocellulose, and cellulose acetate, and thermosetting resins, for example, unsaturated polyester resins, polyester resins, polyurethane resins, and aminoalkyd resins, in known amounts.

The heat transferable protective overcoat layer formulation may be formed by dissolving or dispersing the various resins, the light stabilizer, and optional beads in a suitable solvent, such as a mixture of toluene and n-butanol. An ultraviolet (UV) absorber may also be included in the formulation. While any known UV absorber may be used, the useful material is TINUVIN® 460 (Ciba).

Although not required for this invention, inorganic particles or organic beads other than the crosslinked elastomeric beads may be added.

The formulation is coated onto the support sheet, for example, by gravure printing, screen printing, or reverse coating using a gravure plate, and drying the coating. The formulation is generally applied to provide a dry coverage of at least 0.03 g/m$^2$ to and including 1.7 g/m$^2$ to obtain a dried layer of less than 1 μm. Thicker coatings can be applied if desired, for example in the 2 to 3 g/m$^2$ range.

In one embodiment of the invention, the protective overcoat layer contains, at least 20% to and including 45% by weight poly(vinyl acetal) binder, typically at least 35% to and including 45% by weight polystyrene/allyl alcohol polymeric binder, typically at least 40 to and including 50%, at least 0.5% to and including 3.0%, typically at least 1.0% to and including 2.0% by weight of the N-oxyl radical light stabilizer, at least 0 to and including 30%, typically at least 3% to and including 15% by weight of the UV absorbing compound, and at least 0.5 weight % to and including 4 weight % crosslinked elastomeric beads, typically at least 1.0 weight % to and including 3.0 weight %.

In practice, yellow, magenta and cyan dyes are thermally transferred from a dye donor element to form an image on the dye receiving element or sheet. The thermal head is then used to transfer a clear protective overcoat layer from a clear patch on the dye donor element or from a separate donor element, onto the dye imaged receiving sheet by uniform application of heat. The clear protective overcoat layer adheres to the print and is released from the donor support in the area where heat is applied.

An adhesive layer may be provided on the surface of the heat transferable protective overcoat layer to improve transferability and adhesion to the receiver surface. The adhesive layer may be formed of any conventional pressure-sensitive adhesive or heat sensitive adhesive having a glass transition temperature (Tg) of at least 40° C. to and including 80° C. To maintain high gloss and freedom from iridescence, material selection is determined by refractive index matching requirements.

The protective overcoat layer may be provided on the substrate sheet through a peel layer. The provision of the peel layer permits the overcoat layer to be more easily transferred from the thermal transfer sheet onto the receiver. The peel layer may comprise, for example, waxes, such as microcrystalline wax, carnauba wax, paraffin wax, Fischer-Tropsh wax, various types of low-molecular weight polyethylene, Japan wax, beeswax, spermaceti, insect wax, wool wax, shellac wax, candelilla wax, petrolactum, partially modified wax, fatty esters, and fatty amides, and thermoplastic resins, such as silicone wax, silicone resin, fluororesin, acrylic resin, polyester resin, polyurethane resin, cellulose resin, vinyl chloride-vinyl acetate copolymer, and nitrocellulose. Further, the peel layer may comprise a binder resin and a releasable material. Binder resins usable herein include thermoplastic resins, for example, acrylic resins, such as poly(methyl methacrylate), poly(ethyl methacrylate), poly(butyl acrylate), vinyl resins, such as poly(vinyl acetate), vinyl chloride-vinyl acetate copolymer, poly(vinyl alcohol), poly(vinyl butyral), and cellulose derivatives, such as ethyl cellulose, nitrocellulose, and cellulose acetate, and thermosetting resins, for example, unsaturated polyester resins, polyester resins, polyurethane resins, and aminoalkyd resins. Releasable materials include but are not limited to waxes, silicone wax, silicone resins, melamine resins, fluororesins, fine powders of talc or silica, and lubricants such as surfactants or metal soaps.

The peel layer may be formed by dissolving or dispersing the materials in a suitable solvent to prepare a coating liquid for a peel layer, coating the coating liquid onto a substrate sheet by gravure printing, screen printing, reverse coating using a gravure plate or other means, and drying the coating. The coverage is generally at least 0.1 g/m$^2$ to and including 10 g/m$^2$ on a dry basis.

The donor element of the present invention may be used in sheet form or in a continuous roll or ribbon.

In some embodiments of the invention, the donor element comprises a poly(ethylene terephthalate) support coated with sequential repeating areas of yellow, cyan and magenta dye, and the inventive protection overcoat layer. The process steps are sequentially performed for each color to obtain a three-color dye transfer image with a protection layer on top.

The donor layer can include beads. The beads can have a particle size of at least 0.5 μm to and including 20 μm, typically at least 2.0 μm to and including 15 μm. The beads can act as spacer beads under the compression force of a wound up donor roll, improving raw stock keeping of the donor roll by reducing the material transferred from the donor layer to the slipping layer, as measured by the change in sensitometry under accelerated aging conditions, or the appearance of unwanted dye in the protective overcoat layer, or from the backside of the donor element, for example, a slipping layer, to the donor layer. The use of the beads can result in reduced mottle and improved image quality. The beads can be employed in any amount effective for the intended purpose. In general, good results have been obtained at a coverage of at least 0.003 g/m$^2$ to and including 0.20 g/m$^2$. Beads suitable for the donor layer can also be used in the slip layer.

The beads in the donor layer can be crosslinked, elastomeric beads. The beads in the donor layer can be hard polymeric beads. Suitable beads can include divinylbenzene beads, beads of polystyrene crosslinked with at least 20 weight % divinylbenzene, and beads of poly(methyl methacrylate) crosslinked with at least 20 weight % divinylbenzene, ethylene glycol dimethacrylate, 1,4-cyclohexylene-bis (oxyethyl)dimethacrylate, 1,4-cyclohexylene-bis (oxypropyl)dimethacrylate, or other crosslinking monomers known to those familiar with the art.

Useful elastomeric microbeads have a lower Tg and are compressed under the weight of the thermal print head during printing, thereby allowing better contact between the donor and dye receiver elements. When microbeads having a high Tg are used, the microbeads are too rigid and prevent intimate contact between the donor and dye receiver during printing, resulting in image mottle and poor image quality. The improved dye donor element/dye receiver element contact achievable with the low Tg elastomeric microbeads results in reduced mottle and improved image quality. The crosslinked elastomeric beads employed in the invention have a Tg of 45° C. or less, or typically 10° C. or less.

The donor layer of the donor element can be formed or coated on a support. The donor layer composition can be dissolved in a solvent for coating purposes. The donor layer can be formed or coated on the support by techniques such as, but not limited to, a gravure process, spin-coating, solvent-coating, extrusion coating, or other methods known to practitioners in the art.

The protective overcoat layer of the donor element may be coated on the support or printed thereon by a printing technique such as a gravure process.

A slipping layer may be used on the back side of the heat transferable donor element of the invention to prevent the printing head from sticking to the donor element. Such a slipping layer would comprise either a solid or liquid lubricating material or mixtures thereof, with or without a polymeric binder or a surface-active agent. Useful lubricating materials include oils or semi-crystalline organic solids that melt below 100° C. such as poly(vinyl stearate), beeswax, perfluorinated alkyl ester polyethers, poly-caprolactone, silicone oil, poly(tetrafluoroethylene), carbowax, poly (ethylene glycols), or any of those materials disclosed in U.S. Pat. Nos. 4,717,711; 4,717,712; 4,737,485; and 4,738,950, all incorporated herein by reference. Suitable polymeric binders for the slipping layer include poly(vinyl alcohol-co-butyral), poly(vinyl alcohol-co-acetal), polystyrene, poly (vinyl acetate), cellulose acetate butyrate, cellulose acetate propionate, cellulose acetate, or ethyl cellulose.

For example, the slipping layer formulation most desired for resistive head thermal media incorporates a synergistic combination of lubricants from a friction perspective and in terms of headwear or print head buildup. This slip layer is disclosed in U.S. Pat. No. 7,078,366 that is incorporated herein by reference. Primarily, it includes a donor element for thermal dye transfer comprising a support having on one side thereof a heat transferable layer and on the other side a slipping layer comprising a material comprising a maleic anhydride polyethylene graft copolymer and at least one other hydrocarbon wax. There can be a protective overcoat layer on one side of the donor element and on the other side a slipping layer comprising a lubricating material. The lubricating material comprises a solid polymer derived from a polyolefin and an ethylenically unsaturated carboxylic acid or ester or anhydride thereof; and at least one wax. The polymer may be an alpha-olefin maleic anhydride copolymer, a maleic anhydride polyethylene graft copolymer, a copolymer of an alpha-olefin and isopropyl maleate. The polyolefin is derived from an alpha-olefin containing between about two to about eight carbon atoms, preferably where the alpha-olefin is ethylene and/or propylene. The ethylenically unsaturated carboxylic acids are those having at least 3 to and including 12 carbon atoms. The ethylenically unsaturated carboxylic acid, ester or anhydride may be, for example, maleic acid, ethylmaleic acid, propylmaleic acid, isopropyl maleic acid, fumaric acid, methylenemalonic acid, glutaconic acid, itaconic acid, methylitaconic acid, mesacomic acid, citraconic acid, or a mixture thereof, as well as corresponding esters, anhydrides or mixtures of such acids, esters and anhydrides. The other wax can be an olefinic wax, a saturated hydrocarbon polymer, a linear low molecular weight polyethylene, a branched hydrocarbon with a number average molecular weight of no more than about 10,000 and a melting point or softening point of no more than about 120° C., or a synthetic wax comprising a saturated or unsaturated hydrocarbon. The other wax may be selected from, for example, a mineral wax, a vegetable wax, an animal wax or a synthetic wax that is a saturated or unsaturated hydrocarbon polymer. The ratio of the first wax to the other wax is 5:1 to 1:10. Typically, the slipping layer comprises at least three different waxes, the polymer derived from the polyolefin and the ethylenically unsaturated carboxylic acid or ester or anhydride thereof, a highly branched alpha-olefin polymer, and at least one other wax. This slipping layer formulation for resistive head thermal media incorporates a synergistic combination of lubricants from a friction perspective and in terms of headwear buildup. Additional benefits include preventing or reducing folds, especially when used with relatively fast printers, for example at 4 milliseconds or less per line. A still further benefit is the prevention of retransfer of dye from the dye donor during production. Finally, the slip layer is capable of being coated at high speed.

The amount of lubricating material used in the slip layer is dependent, at least in part, upon the type of lubricating material, but can be in the range of at least 0.001 g/m$^2$ to and including 2 g/m$^2$, although less or more lubricating material can be used as needed. If a polymeric binder is used, the lubricating material can be present in a range of at least 0.1 weight % to and including 50 weight %, typically at least 0.5 weight % to and including 40 weight %, of the polymeric binder. In one embodiment, the slipping layer comprises at least 10 weight % to and including 80 weight % of the polymer derived from a polyolefin and an ethylenically unsaturated carboxylic acid or ester or anhydride thereof; at least 10% weight to and including 80% percent of the highly branched $\alpha$-olefin polymer, and at least 10 weight % to and including 80 weight % of a substantially linear wax, based on the total weight of the three waxes.

Any binder may also be used in the slipping layer provided it will be useful for the intended effect. In some embodiments, polymeric thermoplastic binders are employed. Examples of such materials include, for example, poly(styrene-co-acrylonitrile) (70/30 wt. ratio); poly(vinyl alcohol-co-butyral) (available commercially as Butvar® 76™ by Monsanto Corp.); poly(vinyl alcohol-co-acetal); poly(vinyl alcohol-co-benzal); polystyrene; poly(vinyl acetate); cellulose acetate butyrate; cellulose acetate propionate; cellulose acetate; ethyl cellulose; cellulose triacetate; poly(methyl methacrylate); and copolymers of methyl methacrylate. In another embodiment, the thermoplastic binder is cellulose acetate propionate or polyvinyl acetal.

The amount of the optional binder employed in the slipping layer of the invention is not critical such as at least 0.1 g/m$^2$ to and including 2 g/m$^2$.

The dye receiving element that is used with the donor element of the present invention usually comprises a support having thereon a dye image receiving layer. The support for the image receiving layer may be transparent or reflective. The support may be a transparent film such as a poly(ether sulfone), a polyimide, a cellulose ester such as cellulose acetate, a poly(vinyl alcohol-co-acetal) or a poly(ethylene terephthalate). Opaque, reflective supports can include plain paper, coated paper, synthetic paper, photographic paper support, melt-extrusion-coated paper, and laminated paper, such as biaxially oriented support laminates. Biaxially oriented support laminates suitable for use as receivers are described in U.S. Pat. Nos. 5,853,965; 5,866,282; 5,874,205; 5,888,643; 5,888,681; 5,888,683; and 5,888,714, all incorporated herein by reference. Biaxially oriented supports can include a paper base and a biaxially oriented polyolefin sheet, for example, polypropylene, laminated to one or both sides of the paper base. The support can be a reflective paper, for example, baryta-coated paper, white polyester (polyester with white pigment incorporated therein), an ivory paper, a condenser paper, or a synthetic paper, for example, DuPont Tyvek® by E.I. DuPont de Nemours and Company (Wilmington, Del.). The support can be employed at any desired thickness, for example, at least 10 μm to and including 1000 μm. Exemplary supports for the dye image-receiving layer are disclosed in U.S. Pat. Nos. 5,244,861 and 5,928,990 and EP Publication 671,281, all incorporated herein by reference. Other suitable supports as known to practitioners in the art can also be used. According to various embodiments, the support can be a composite or laminate structure comprising a base layer and one or more additional layers. The base layer can comprise more than one material, for example, a combination of one or more of a microvoided layer, a foamed layer, a layer with hollow particles, a nonvoided layer, a synthetic paper, a natural paper, and a polymer. The dye image-receiving layer may comprise, for example, a polycarbonate, a polyurethane, a polyester, poly(styrene-co-acrylonitrile), polycaprolactone, vinyl-series resins, such as halogenated polymers (for example, polyvinyl chloride and polyvinylidene chloride), poly(vinyl acetate), ethylene-vinyl acetate copolymer, vinyl chloride-vinyl acetate copolymer, or mixtures thereof. Latex polymers may be used in the dye image-receiving layer. The latex polymer may be a dispersion in which hydrophobic polymers comprising a monomer unit of, for example, water-insoluble vinyl chloride dispersed as fine particles in a water-soluble dispersion medium. The dispersed state may be one in which polymer is emulsified in a dispersion medium, one in which polymer underwent emulsion polymerization, one in which polymer underwent micelle dispersion, one in which polymer molecules partially have a hydrophilic structure, or the like. For such latex polymers it is desirable to prepare the dye image-receiving layer by applying an aqueous type coating solution and then drying it. Exemplary aqueous coating formats are disclosed in U.S. Patent Application Publication 2008/0254241. The dye image-receiving layer may be present in any amount that is effective for the intended purpose. In general, good results have been obtained at a concentration of at least 1 $g/m^2$ to and including 5 $g/m^2$.

Additional polymeric layers can be present between the support and the dye image-receiving layer. The additional layers can provide coloring, adhesion, antistatic properties, act as a dye-barrier, act as a dye mordant layer, or a combination thereof. For example, a polyolefin such as polyethylene or polypropylene can be present. White pigments such as titanium dioxide, zinc oxide, and the like can be added to the polymeric layer to provide reflectivity.

A subbing layer can be used over the polymeric layer in order to improve adhesion to the dye image-receiving layer. This can be called an adhesive or tie layer. Exemplary subbing layers are disclosed in U.S. Pat. Nos. 4,748,150, 4,965,238, 4,965,239, and 4,965,241 all of which are incorporated herein by reference. An antistatic layer as known to practitioners in the art can also be used in the receiver element. The receiver element can also include a backing layer. Suitable examples of backing layers include those disclosed in U.S. Pat. Nos. 5,011,814 and 5,096,875 both of which are incorporated herein by reference.

The dye image-receiving layer, or an overcoat layer thereon, can contain a release agent, for example, a silicone or fluorine based compound, as is conventional in the art. Various exemplary release agents are disclosed, for example, in U.S. Pat. Nos. 4,820,687 and 4,695,286, the disclosures of which are incorporated herein by reference.

The receiver element can also include stick preventative agents, as described for the donor element. The receiver element and dye donor element can include the same stick preventative agent.

The dye image-receiving layer can be formed on the support by any method known to practitioners in the art, including but not limited to printing, solution coating, dip coating, and extrusion coating. When the dye image-receiving layer is extruded, the process can include (a) forming a melt comprising a thermoplastic material; (b) extruding or coextruding the melt as a single-layer film or a layer of a composite (multilayer or laminate) film; and (c) applying the extruded film to the support for the receiver element. Exemplary extruded receiving layer formats are disclosed in U.S. Pat. Nos. 7,125,611, 7,091,157, 7,005,406, 6,893,592, and 6,897,183, the disclosures of which are incorporated by reference.

The donor element of this invention can also include a stick preventative agent to reduce or eliminate sticking between the donor element and the receiver element during printing. The stick preventative agent can be present in any layer of the donor element, so long as the stick preventative agent is capable of diffusing through the layers of the donor element to the heat transferable layer, or transferring from the slip layer to the heat transferable layer. For example, the stick preventative agent can be present in one or more patches of the heat transferable layer, in the support, in an adhesive layer, in a dye-barrier layer, in a slip layer, or in a combination thereof. According to various embodiments, the stick preventative agent can be in the slip layer, the heat transferable layer, or both. The stick preventative agent can be in one or more patches of that. If more than one dye patch is present in the heat transferable layer, the stick preventative agent can be present in the last patch of the layer to be printed, such as the cyan layer. However, the dye patches and protective overcoat patches can be in any order. The stick preventative agent can be a silicone- or siloxane-containing polymer. Suitable polymers can include graft copolymers, block polymers, copolymers, and polymer blends or mixtures. Suitable stick preventative agents are described, for example, in U.S. Pat. No. 7,067,457 that is incorporated herein by reference.

Release agents as known to practitioners in the art can also be added to the dye donor element, for example, to the dye donor layer, the slip layer, or both. Suitable release agents can include, for example, those described in U.S. Pat. Nos. 4,740,496 and 5,763,358 that are incorporated herein by reference.

Thermal printing heads, which can be used to transfer heat transferable materials from the donor elements of the invention, are available commercially. There can be employed, for example, a Fujitsu Thermal Head FTP-040 MCSOO1, a TDK Thermal Head LV5416 or a Rohm Thermal Head KE 2008-F3.

A thermal transfer assemblage of the invention comprises (a) a heat transferable donor element, and (b) a dye receiving element, the dye receiving element being in a superposed relationship with the heat transferable donor element so that the heat transferable layer of that donor element is in contact with the dye image-receiving layer of the receiving element.

The assemblage comprising these two elements may be pre-assembled as an integral unit. This may be done by temporarily adhering the two elements together at their margins. After transfer, the dye receiving element is then peeled apart to reveal the dye transfer image.

When a three-color image is to be obtained, the assemblage is formed on three occasions during the time when heat is applied by the thermal printing head. After the first dye is transferred, the elements are peeled apart. A second dye donor element (or another area of the donor element with a different dye area) is then brought in register with the dye receiving element and the process is repeated. The third color is obtained in the same manner. Finally, a protective overcoat layer is applied on top.

When a protective overcoat material is applied, it can be patterned to provide a matte or glossy finish by varying thickness, line time, print energy, or some combination thereof. Further, expandable or pre-expanded beads can be used in a laminate or protective overcoat layer to affect a gloss or matte finish depending on the amount and size of the beads. Overcoats, whether patterned or not, can be provided on any colorant containing material, for example but not limited to, printed ink jet, thermal, or electrophotographic receivers, or silver halide prints.

EXAMPLES

The following examples are provided to illustrate the invention.

Receiving Elements:

Thermal Receiver R-1 was used throughout these experiments, having an overall thickness of about 220 μm and a thermal dye receiving layer thickness of about 3 μm. R-1 was prepared by melt extruding the tie layer and dye receiving layer onto the paper support, resulting in the following structure:

| |
|---|
| Co-extruded polyester-polycarbonate-silicone dye receiving layer |
| PELESTAT ® 300 (Sanyo Chemical Industries, Ltd.) tie layer |
| Microvoided composite film OPPalyte ® 350 K18 (ExxonMobil) |
| Pigmented polyethylene |
| Cellulose Paper |
| Polyethylene |
| Polypropylene film |

KODAK Professional EKTATHERM ribbon, catalogue #106-7347, was used in a KODAK Thermal Photo Printer, model number 6850, with receiver R-1 to produce multiple, identical test target prints whose records were composed of neutral, monochrome, and bi-chromes consisting of two colors. Each record was arranged in a 15 step incremental density change from minimum density (Dmin) to maximum density (Dmax). The control or experimental protective overcoat patch on the donor ribbon was then transferred onto a test target print. The protective overcoats were laminated with a transfer line-time of 0.8 ms.

Control Donor Element C-1

KODAK Professional EKTATHERM ribbon, catalogue #106-7347, was used in a KODAK Thermal Photo Printer, model number 6850.

The protective overcoat of the donor elements were prepared by coating on the back side of a 4.5 μm polyethylene terephthalate) support:

1) a subbing layer of titanium alkoxide, Tyzor TBT®, (DuPont Corp.) (0.13 g/m$^2$) from a n-propyl acetate and n-butyl alcohol solvent mixture (85/15), and 2) a slipping layer containing 0.02 g/m$^2$ Polywax® 400, 0.02 g/m$^2$ Vybar® 103, 0.02 g/m$^2$ Ceramer 1608, all from Baker-Petrolite Corp., and 0.38 g/m$^2$ poly(vinyl acetal) binder KS-1 from Sekisui Co, coated from a 75/20/5 solvent mixture of toluene, methanol, and cylcopentanone.

A transferable protective overcoat layer of poly(vinyl acetal) KS-10 at a laydown of 0.63 g/m$^2$, IPA-ST (Nippon) at a laydown of 0.46 g/m$^2$, and UV Absorber TINUVIN® 460 (Ciba Specialties Co.), was coated on the front side of the donor element at a laydown of 0.11 g/m$^2$, and contained 4 μm poly(divinylbenzene) beads at a laydown of 0.03 g/m$^2$. The materials were coated from solvent 3-pentanone.

Comparative Examples 1-20

Comparative Example 1 was prepared as Control Donor Element C-1 except the front side of the element was prepared in the following manner:

To a magnetically stirred 16 oz. clear jar with threaded cap containing 226 g toluene and 25 g n-butanol was added 19.8 g polyvinyl acetal KS-10 from Sekisui. The mixture was stirred at room temperature until a solution was obtained. Then, 22.5 g of styrene/allyl alcohol copolymer (Lyondell SAA-100) were added and the mixture was stirred at room temperature until a solution was obtained. Further, 4.37 g of Tinuvin® 460 (Ciba) were added and the mixture stirred at room temperature until a solution was obtained. Additionally, 0.52 g of TEMPO (Evonik/Degussa) was added and the mixture stirred at room temperature until a solution was obtained. Then, 1.30 g of four (4) μm poly(divinylbenzene) beads were added and the mixture was stirred for 24 hours. The resulting mixture was coated on the front side of the donor element to give the TEMPO and Tinuvin® 460 levels shown in TABLE 1 below.

Comparative Examples 2-6 were produced as in Comparative Example 1 but in the absence of Tinuvin® 460, and with increasing amounts of TEMPO of 0 up to 0.0215 g/m$^2$ in increments of 0.0054 g/m$^2$.

Comparative Examples 7-20 were produced as in Comparative Example 1 but with Tinuvin® 460 in increasing amounts of 0.045, 0.090, and 0.180 g/m$^2$, and with increasing amounts of TEMPO (0 to 0.0215 g/m$^2$) in increments of 0.0054 g/m$^2$.

Light Fade Test Method

Test target Status A densities were measured with an X-Rite Transmission/Reflection Densitometer model 820 from X-Rite Incorporated.

The test targets were subjected to 50 Klux high intensity daylight using a xenon light source at room temperature. Test target dye densities were read at 1.0 and Delta density changes from start densities were calculated and reported as a Delta density. A lower absolute number indicates less change from the original sample, and therefore a better result (for example, −0.20 is better than −0.40, having less color change). TABLES 1-4 show the results of shifts in blue and red at the end of a 28 day fade period. TABLES 5 and 6 show the results of shifts in blue and red at the end of a 21 day fade period.

TABLE 1

| Donor Element | TEMPO (g/m$^2$) | Tinuvin ® 460 (g/m$^2$) | Delta Blue of Red | Delta Red of Blue |
|---|---|---|---|---|
| Control C-1 | 0 | 0.0900 | −0.40 | −0.39 |
| Comparative 1 | 0.0108 | 0.0900 | −0.26 | −0.24 |
| Comparative 2 | 0 | 0 | −0.47 | −0.56 |
| Comparative 3 | 0.0054 | 0 | −0.34 | −0.43 |
| Comparative 4 | 0.0108 | 0 | −0.29 | −0.37 |
| Comparative 5 | 0.0162 | 0 | −0.28 | −0.35 |
| Comparative 6 | 0.0216 | 0 | −0.27 | −0.33 |

The data in TABLE 1 show the improvement in light fade by use of TEMPO as compared to Tinuvin® 460.

TABLE 2

| Donor Element | TEMPO ($g/m^2$) | Tinuvin ® 460 ($g/m^2$) | Delta Blue of Red | Delta Red of Blue |
|---|---|---|---|---|
| Control C-1 | 0 | 0.0900 | −0.40 | −0.39 |
| Comparative 7 | 0 | 0.0450 | −0.40 | −0.46 |
| Comparative 8 | 0.0054 | 0.0450 | −0.29 | −0.32 |
| Comparative 9 | 0.0108 | 0.0450 | −0.27 | −0.29 |
| Comparative 10 | 0.0162 | 0.0450 | −0.27 | −0.28 |
| Comparative 11 | 0.0216 | 0.0450 | −0.25 | −0.24 |

The data in TABLE 2 demonstrate how the addition of TEMPO to the protective overcoat allows for the coverage reduction of Tinuvin® 460 from 0.0900 $g/m^2$ to one half the coverage, 0.0450 $g/m^2$.

TABLE 3

| Donor Element | TEMPO ($g/m^2$) | Tinuvin ® 460 ($g/m^2$) | Delta Blue of Red | Delta Red of Blue |
|---|---|---|---|---|
| Control C-1 | 0 | 0.0900 | −0.40 | −0.39 |
| Comparative 12 | 0 | 0.0900 | −0.37 | −0.40 |
| Comparative 13 | 0.0054 | 0.0900 | −0.28 | −0.27 |
| Comparative 14 | 0.0108 | 0.0900 | −0.26 | −0.24 |
| Comparative 15 | 0.0162 | 0.0900 | −0.25 | −0.24 |
| Comparative 16 | 0.0216 | 0.0900 | −0.24 | −0.21 |

The data in TABLE 3 demonstrate the improvement in image stability achieved by the addition of TEMPO where the coverage of Tinuvin® 460 is equal to that in C-1.

TABLE 4

| Donor Element | TEMPO ($g/m^2$) | Tinuvin ® 460 ($g/m^2$) | Delta Blue of Red | Delta Red of Blue |
|---|---|---|---|---|
| Control C-1 | 0 | 0.0900 | −0.40 | −0.39 |
| Comparative 17 | 0 | 0.1800 | −0.33 | −0.34 |
| Comparative 18 | 0.0054 | 0.1800 | −0.27 | −0.22 |
| Comparative 19 | 0.0108 | 0.1800 | −0.24 | −0.19 |
| Comparative 20 | 0.0162 | 0.1800 | −0.23 | −0.17 |

The data in TABLE 4 demonstrate the image stability improvement resulting from increased solubility of Tinuvin® 460 in a solvent mixture.

Comparative Example 21

The donor element of this Example was prepared as described for Comparative Example 1, but substituting Tinuvin® 123 for TEMPO. The data in TABLE 5 demonstrate the importance of low molecular weight HALS. Tinuvin® 123, a commercially available hindered amine light stabilizer with the structure shown below, has a large molecular weight (737 MW) relative to TEMPO (156 MW). Also, Tinuvin® 123 exists as the alkyl oxy not the nitroxyl radical of TEMPO. Tinuvin® 123 is available from Ciba [bis(1-octyloxy-2,2,6,6-tetramethyl-4-piperidyl) sebacate] and has the following structure:

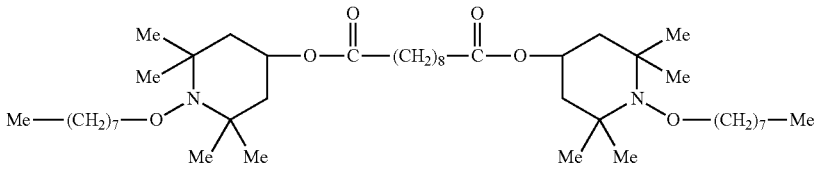

TABLE 5

| Donor Element | Tinuvin ® 123 ($g/m^2$) | Tinuvin ® 460 ($g/m^2$) | Delta Blue of Red |
|---|---|---|---|
| Control C-1 | 0 | 0.0900 | −0.51 |
| Comparative Example 21 | 0.0108 | 0.0900 | −0.53 |

Comparative Iridescence

After lamination of the protective overcoat donor elements to the imaged receiver, samples were visually assessed for iridescence on a scale of 0 (none) to 5 (severe). TABLE 7 below shows data for samples laminated at 0.8 ms line-time.

TABLE 7

| Donor Element | Iridescence |
|---|---|
| Control C-1 | 3 |
| Comparative 1 | 0 |
| Comparative 2 | 0 |
| Comparative 3 | 0 |
| Comparative 4 | 0 |
| Comparative 5 | 0 |
| Comparative 6 | 0 |
| Comparative 7 | 0 |
| Comparative 8 | 0 |

Invention Example 1

The use of Evonik TEMPO (2,2,6,6-tetramethyl-piperidine-1-oxyl, $C_9H_{18}NO$) was compared to the use of DKSH Luna PI-172 (4-Hydroxy-TEMPO free radical, $C_9H_{18}NO_2$) as light stabilizer.

A dye-donor element was prepared by coating sequential areas of cyan, magenta and yellow dye and protective overcoat or laminate on 4.5 μm poly(ethylene terephthalate) support. The dye donor side was prepared by first coating a subbing layer of a titanium alkoxide (DuPont Tyzor TBT®) (0.12 $g/m^2$) from n-propyl acetate and n-butyl alcohol solvent mixture, the protective overcoat was coated on bare poly(ethylene terephthalate) support. The back side (non-donor side) was prepared by first coating a subbing layer of a titanium alkoxide (DuPont Tyzor TBT®) (0.12 $g/m^2$) from n-propyl acetate and n-butyl alcohol solvent mixture and then a slipping layer as described in U.S. Pat. No. 7,109,147B2 that in incorporated herein by reference.

To understand the effect of DKSH Luna PI-172 (hereafter referred to as PI-172) and Evonik TEMPO (hereafter referred to as TEMPO) an experiment was undertaken to compare in a laminate formulation matrix.

TEMPO has the formula (A) in which $R_3$ and $R_4$ are each hydrogen and each of $R_1$, $R_2$, $R_5$, and $R_6$ is unsubstituted methyl. DKSH Luna PI-172 has the formula (B) wherein each of $R_1$, $R_2$, $R_5$, and $R_6$ is unsubstituted methyl, and the keto group in formula (B) can be changed into a hydroxy group in the isomeric form of the compound.

Both compounds were added to a base laminate formulation containing the following material:

| Material | Quantity used ($mg/ft^2$) |
|---|---|
| Polyvinyl acetal, KS-10 (Sekisui Chemical) | 56.4 |
| Poly(divinyl benzene) beads, 4 μm (Eastman Kodak Company) | 2.8 |
| IPA-ST (Nissan Chemical) | 25.0 |
| Tinuvin ® 460 (BASF) | 9.6 |
| Diethyl ketone | Solvent |
| Toluene | Solvent |

TABLE 8 below provides results for high intensity daylight testing after 14 days of exposure to 50 kLux HID daylight, of images made using laminates with various levels of the two materials. The results illustrate the magenta density loss as a function of the presence (or absence) of the materials.

TABLE 8

| Formulation ($mg/ft^2$) | TEMPO | PI-172 (0.5 $mg/ft^2$) |
|---|---|---|
| | MAGENTA | |
| 0 | −0.232 | −0.232 |
| 0.50 | −0.188 | −0.158 |
| 1.0 | −0.152 | −0.131 |
| 2.0 | −0.131 | −0.122 |
| | CYAN | |
| 0 | −0.192 | −0.192 |
| 0.50 | −0.157 | −0.137 |
| 1.0 | −0.127 | −0.124 |
| 2.0 | −0.117 | −0.121 |
| | YELLOW | |
| 0 | −0.080 | −0.080 |
| 0.50 | −0.070 | −0.061 |
| 1.0 | −0.060 | −0.054 |
| 2.0 | −0.057 | −0.059 |

These results suggest that DKSH LunaPS-172 performed well as a light stabilizer in the present invention.

The invention has been described in detail with particular reference to certain preferred embodiments thereof, but it will be understood that variations and modifications can be effected within the spirit and scope of the invention.

The invention claimed is:

1. A heat transferable donor element comprising a polymeric support, the support having at least one portion thereof coated with a heat transferable material comprising: crosslinked elastomeric organic beads; at least one light stabilizer that is an N-oxyl radical derived from a hindered amine, the N-oxyl radical having the following formula (A) or formula (B):

(A)

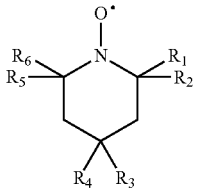

-continued (B)

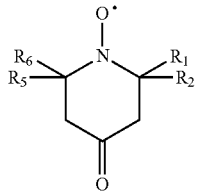

wherein $R_1$, $R_2$, $R_5$, and $R_6$ are each independently selected from a straight or branched $C_1$-$C_6$ alkyl or alkene, $R_3$ and $R_4$ are each independently selected from H, $CH_2CH_3$, $CH_3$, OH, OR, COOH, COOR, or NH—C(═O)R, R is a straight or branched $C_1$-$C_6$ alkyl or alkene, at least one of $R_3$ and $R_4$ is not hydrogen, and the N-oxyl radical has a molecular weight of 600 or less; at least one styrene/allyl alcohol copolymer resin; a UV absorbing material; and at least one poly(vinyl acetal) resin having the following Formula I:

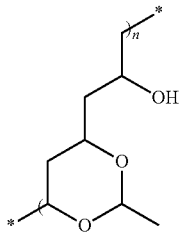

wherein n is from 10 to 100, the heat transferable material comprising 40% to 90% by weight of the at least one poly(vinyl acetal) resin and 2% to 20% by weight of the UV absorbing material, based on the total dry weight of the heat transferable material.

2. The donor element of claim 1, wherein the donor element further comprises one or more colored dye patches.

3. The donor element of claim 1, wherein $R_1$, $R_2$, $R_5$, and $R_6$ are independently H, $CH_3$, or $CH_2CH_3$.

4. The donor element of claim 1, wherein each of $R_1$, $R_2$, $R_5$, and $R_6$ is $CH_3$ or each of $R_1$, $R_2$, $R_5$, and $R_6$ is $CH_2CH_3$.

5. The donor element of claim 1, wherein at least one of $R_3$ and $R_4$ is OH, $CH_2CH_3$, $CH_3$, or —NH—C(═O)$CH_3$.

6. A heat transferable overcoat material comprising:

crosslinked elastomeric organic beads; a light stabilizer that is an N-oxyl radical derived from a hindered amine, the N-oxyl radical having the following formula (A) or formula (B):

(A)

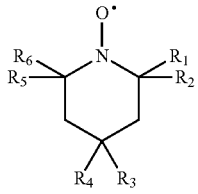

-continued (B)

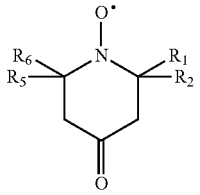

wherein $R_1$, $R_2$, $R_5$, and $R_6$ are each independently selected from a straight or branched $C_1$-$C_6$ alkyl or alkene, $R_3$ and $R_4$ are each independently selected from H, $CH_2CH_3$, $CH_3$, OH, OR, COOH, COOR, or NH—C(═O)R, R is a straight or branched $C_1$-$C_6$ alkyl or alkene at least one of $R_3$ and $R_4$ is not hydrogen, and the N-oxyl radical has a molecular weight of 600 or less; at least one styrene/allyl alcohol copolymer resin; a UV absorbing material; and at least one poly(vinyl acetal) resin having the following Formula I:

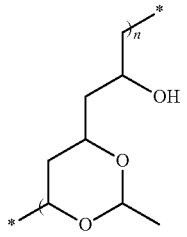

wherein n is from 10 to 100, the heat transferable overcoat material comprising 40% to 90% by weight of the at least one poly(vinyl acetal) resin and 2% to 20% by weight of the UV absorbing material, based on the total dry weight of the heat transferable material.

7. The overcoat material of claim 6, wherein each of $R_1$, $R_2$, $R_5$, and $R_6$ is $CH_3$ or each of $R_1$, $R_2$, $R_5$, and $R_6$ is $CH_2CH_3$, and wherein at least one of $R_3$ and $R_4$ is OH, $CH_2CH_3$, $CH_3$, or NH—C(═O)$CH_3$.

8. A donor element comprising a polymeric support and the heat transferable overcoat material of claim 6.

9. A method of coating a receiver element with a protective overcoat material, comprising:

contacting the donor element of claim 8 with the receiver element;

applying heat or pressure sufficient to transfer the heat transferable overcoat material from the donor element to the receiver element.

10. The method of claim 9, wherein the receiver element is selected from the group consisting of an inkjet receiver, a thermal receiver, an electrophotographic receiver, and a silver halide print.

11. A thermal transfer assemblage comprising a receiver element in contact with at least a portion of a heat transferable donor element, wherein the donor element comprises a polymeric support, at least one portion thereof coated with a heat transferable overcoat material comprising: cross-linked elastomeric organic beads; a light stabilizer that is an N-oxyl radical derived from a hindered amine, the N-oxyl radical having the following formula (A) or formula (B):

(A)

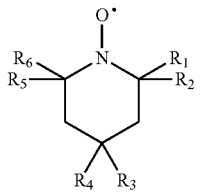

(B)

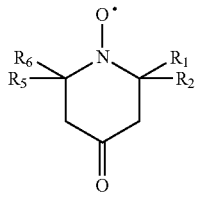

wherein $R_1$, $R_2$, $R_5$, and $R_6$ are each independently selected from a straight or branched $C_1$-$C_6$ alkyl or alkene, $R_3$ and $R_4$ are each independently selected from H, $CH_2CH_3$, $CH_3$, OH, OR, COOH, COOR, or NH—C(═O)R, R is a straight or branched $C_1$-$C_6$ alkyl or alkene, at least one of $R_3$ and $R_4$ is not hydrogen, and the N-oxyl radical has a molecular weight of 600 or less; at least one styrene/allyl alcohol copolymer resin; a UV absorbing material; and at least one poly(vinyl acetal) resin having the following Formula I:

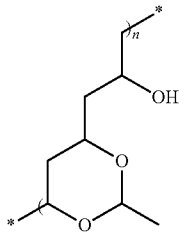

wherein n is from 10 to 100, the heat transferable overcoat material comprising 40% to 90% by weight of the at least one poly(vinyl acetal) resin and 2% to 20% by weight of the UV absorbing material, based on the total dry weight of the heat transferable material.

12. The assemblage of claim 11, wherein the donor element comprises two or more patches, and wherein at least one patch includes a dye and at least one patch includes the heat transferable overcoat material.

13. The assemblage of claim 11, wherein the receiver element is selected from the group consisting of an inkjet receiver, a thermal receiver, an electrophotographic receiver, and a silver halide print.

14. The assemblage of claim 11, wherein each of $R_1$, $R_2$, $R_5$, and $R_6$ is $CH_3$ or each of $R_1$, $R_2$, $R_5$, and $R_6$ is $CH_2CH_3$, and wherein at least one of $R_3$ and $R_4$ is OH, $CH_2CH_3$, $CH_3$, or NH—(C═O)$CH_3$.

15. The assemblage of claim 11, wherein the receiver element comprises a receiver layer and the receiver layer comprises a plasticizer.

* * * * *